US008757692B2

(12) United States Patent
Giampieri et al.

(10) Patent No.: US 8,757,692 B2
(45) Date of Patent: Jun. 24, 2014

(54) GRIPPING ELEMENT OF A BAG FOR PHARMACEUTICAL PRODUCTS

(71) Applicant: AEA S.r.l, Rosora (IT)

(72) Inventors: Simone Giampieri, Polverigi (IT); Federico Ricavi, Corinaldo (IT)

(73) Assignee: AEA, S.r.l., Rosora (IT)

( * ) Notice: Subject to any disclaimer, the term of this patent is extended or adjusted under 35 U.S.C. 154(b) by 0 days.

(21) Appl. No.: 13/943,428

(22) Filed: Jul. 16, 2013

(65) Prior Publication Data

US 2013/0302135 A1 Nov. 14, 2013

Related U.S. Application Data

(63) Continuation of application No. 12/874,258, filed on Sep. 2, 2010, now Pat. No. 8,544,921.

(30) Foreign Application Priority Data

Sep. 2, 2009 (IT) ..... BO2009A0563

(51) Int. Cl.
*B66F 19/00* (2006.01)

(52) U.S. Cl.
USPC ..... 294/214; 294/3; 294/26

(58) Field of Classification Search
USPC ..... 294/2, 86.4, 213, 214, 219, 81.56, 62, 294/15, 26, 152, 3; 604/174–180; 60/131; 132/133; 248/99, 231.85, 68.1, 74.1; 269/3, 6, 43, 45, 95; 211/12, 85.15; 222/93, 105, 475; 383/13, 12, 22, 26
See application file for complete search history.

(56) References Cited

U.S. PATENT DOCUMENTS

| | | | | | |
|---|---|---|---|---|---|
| 3,999,656 | A | * | 12/1976 | Hydorn | 206/279 |
| 4,343,053 | A | * | 8/1982 | O'Connor | 4/452 |
| D304,546 | S | * | 11/1989 | Cattach | D9/708 |
| 5,782,562 | A | * | 7/1998 | Anspacher | 383/15 |
| 6,149,555 | A | * | 11/2000 | Kinback | 482/93 |
| 6,287,289 | B1 | * | 9/2001 | Niedospial, Jr. | 604/408 |
| D507,494 | S | * | 7/2005 | Lucas et al. | D9/707 |
| 7,585,007 | B2 | * | 9/2009 | Johnson et al. | 294/152 |

* cited by examiner

*Primary Examiner* — Stephen Vu
(74) *Attorney, Agent, or Firm* — Lieberman & Brandsdorfer, LLC

(57) ABSTRACT

A gripping element of a bag for pharmaceutical products is provided with two gripping devices adapted to withhold two opposite edges of the bag itself.

56 Claims, 5 Drawing Sheets

GRIPPING ELEMENT OF A BAG FOR PHARMACEUTICAL PRODUCTS

CROSS REFERENCE TO RELATED APPLICATION(S)

This application is a continuation patent application claiming the benefit of the filing date of U.S. patent application Ser. No. 12/874,258, filed on Sep. 2, 2010, and titled "Gripping Element of a Bag for Pharmaceutical Products" now U.S. Pat. No. 8,544,921, which is hereby incorporated by reference.

The present invention relates to a gripping element of a bag for pharmaceutical products. In particular, the present invention relates to a gripping element of a bag for pharmaceutical products comprising a first edge provided with at least one inlet duct for accessing the content of the bag and a second edge opposed to the first edge itself.

BACKGROUND OF THE INVENTION

The gripping element of the type described, for example, in international patent application WO-2008012596-A2 comprises two substantially flat gripping jaws hinged to each another to turn one with respect to the other about a given fulcrum axis between a clamping position and a releasing position of the aforesaid inlet duct and/or first edge.

The gripping elements of the known type described above have some drawbacks mainly deriving from the fact that such gripping elements are shaped to withhold the bag at only one of the two edges, they can correctly withhold the bag only when the second edge, i.e. the free edge, is arranged underneath the first edge, and therefore they do not allow to tip the bag and withhold it with the second edge over the first edge.

SUMMARY OF THE INVENTION

It is an object of the present invention to provide a gripping element of a bag for pharmaceutical products which is free from the above-described drawbacks and which is simple and cost-effective to be implemented.

According to the present invention, a gripping element of a bag for pharmaceutical products is provided as claimed in the attached claims.

BRIEF DESCRIPTION OF THE DRAWINGS

The present invention will now be described with reference to the accompanying drawings, which illustrate a non-limitative embodiment thereof, in which.

DETAILED DESCRIPTION OF THE INVENTION

Figure 1:
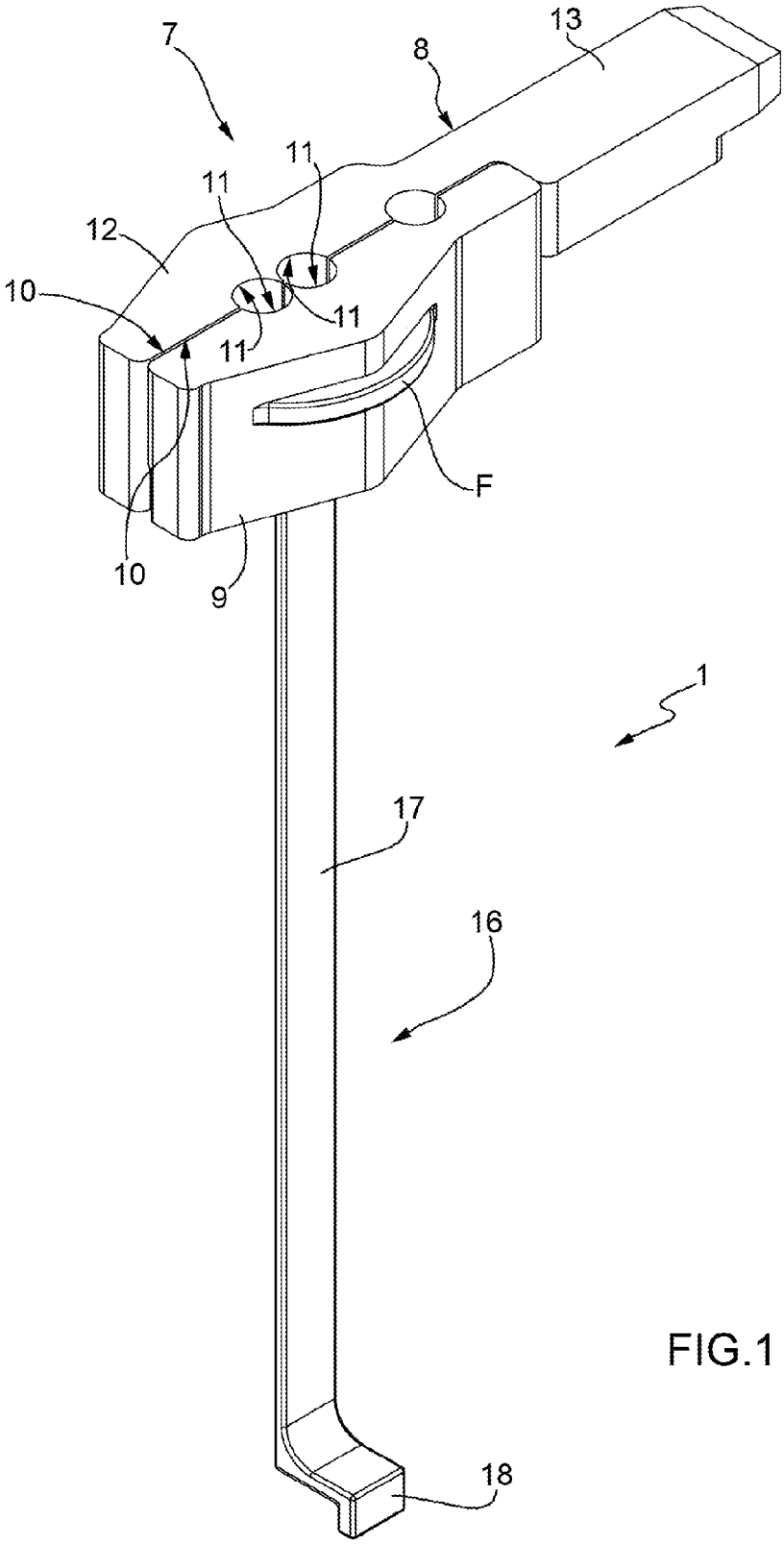
FIG. 1 is a diagrammatic perspective view of a preferred embodiment of the gripping element according to the present invention.
Figure 2:
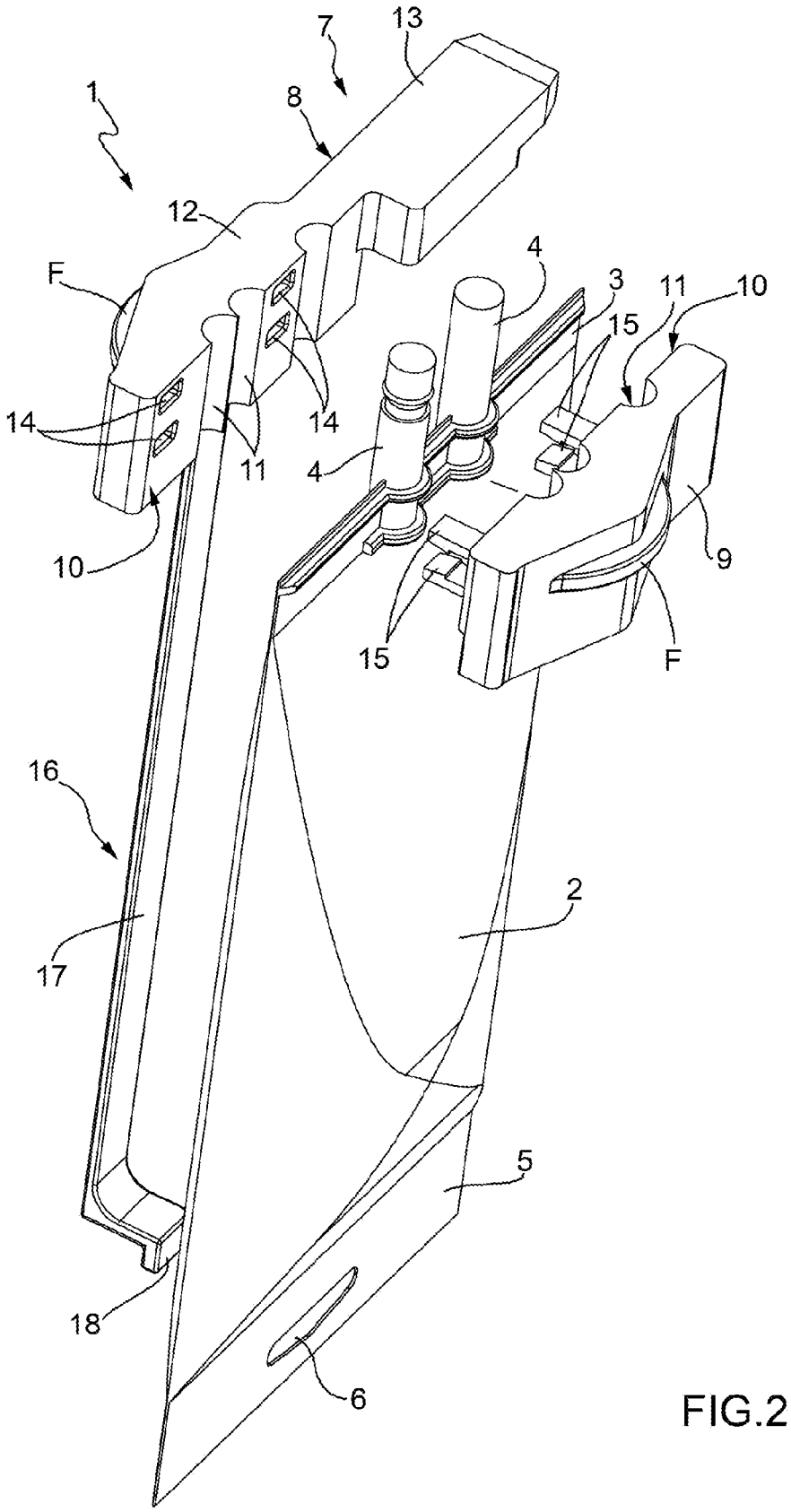
FIG. 2 diagrammatically shows in exploded perspective view the gripping element in FIG. 1 and a bag for pharmaceutical products.

With reference to FIGS. 1 and 2, numeral 1 indicates, as a whole, a gripping element normally used in a machine for preparing pharmaceutical products of the type described, for example, in international patent application WO-2008012596-A2 entirely incorporated herein as reference.

The gripping element 1 is adapted to withhold a bag 2 of pharmaceutical products having a first, substantially flat edge 3 provided, in the case in point, with two inlet ducts 4 to access the content of the bag 2, and a second, substantially flat edge 5, opposed to the edge 3, and provided with an opening 6 obtained through the edge 5 itself.

The gripping element 1 comprises a first gripping device 7, which is adapted to withhold the edge 3 and/or the ducts 4, and comprises, in turn, two substantially flat shaped jaws 8, 9, each of which is made in one piece separate from the other jaw 8, 9, is limited by a substantially flat face 10 facing, in use, the face 10 of the other jaw 8, 9, and has a plurality of substantially semi-cylindrical cavities 11 (three cavities 11, in the case in point) obtained on the face 10 to receive the ducts 4.

Jaw 8 is longer than jaw 9, comprises a coupling portion 12 coupled in use to the jaw 9 and a coupling portion 13 with a seat of a store (not shown), and is provided, in the case in point, with four slots 14, which open outwards at the respective face 10, and are each adapted to receive and withhold a respective tooth 15 which protrudes from the jaw 9 perpendicular to the respective face 10, and is blocked by fitting inside the respective slot 14.

Jaw 9 and portion 12 are each provided with a respective coupling flange F to a robotic handler (not shown), while portion 13 is provided with a coupling element (not shown) of the gripping element 1 to the mentioned seat of the store (not shown).

The gripping element 1 further comprises a second gripping device 16, which is adapted to withhold the edge 5, and comprises, in turn, a rigid elongated bracket 17, which is substantially L-shaped, it protrudes from the jaw 8 transversally from the jaw 8 itself, and has a free end defining a hook 18 adapted to engage the opening 6 of the edge 5 itself.

From the above, it derives that the shape of the gripping element 1 allows to withhold the bag 2 both at edge 3 and at edge 5, and thus allows to orient the bag 2 both in horizontal position and in a vertical position, wherein the edge 3 is arranged over the edge 5 and the ducts 4 are faced upwards, and in a vertical position, wherein the edge 3 is arranged underneath the edge 5 and the inlets 4 are faced downwards.

According to some variants not shown:

- jaws 8, 9 are hinged to each another to turn with respect to each other between the clamping and the releasing position;
- the gripping element 1 is provided with an identification device of the bag 2 withheld by the gripping element 1 itself and of its content, in particular a RFID tag mounted in one of the jaws 8,9;
- hook 18 is slidably coupled to the bracket 17 to allow a correct tensioning of the bag 2; and
- hook 18 is eliminated and replaced by at least one pliers 23 and 24 gripping element movable between a clamping position and a releasing position of the edge 5.

Figure 3:
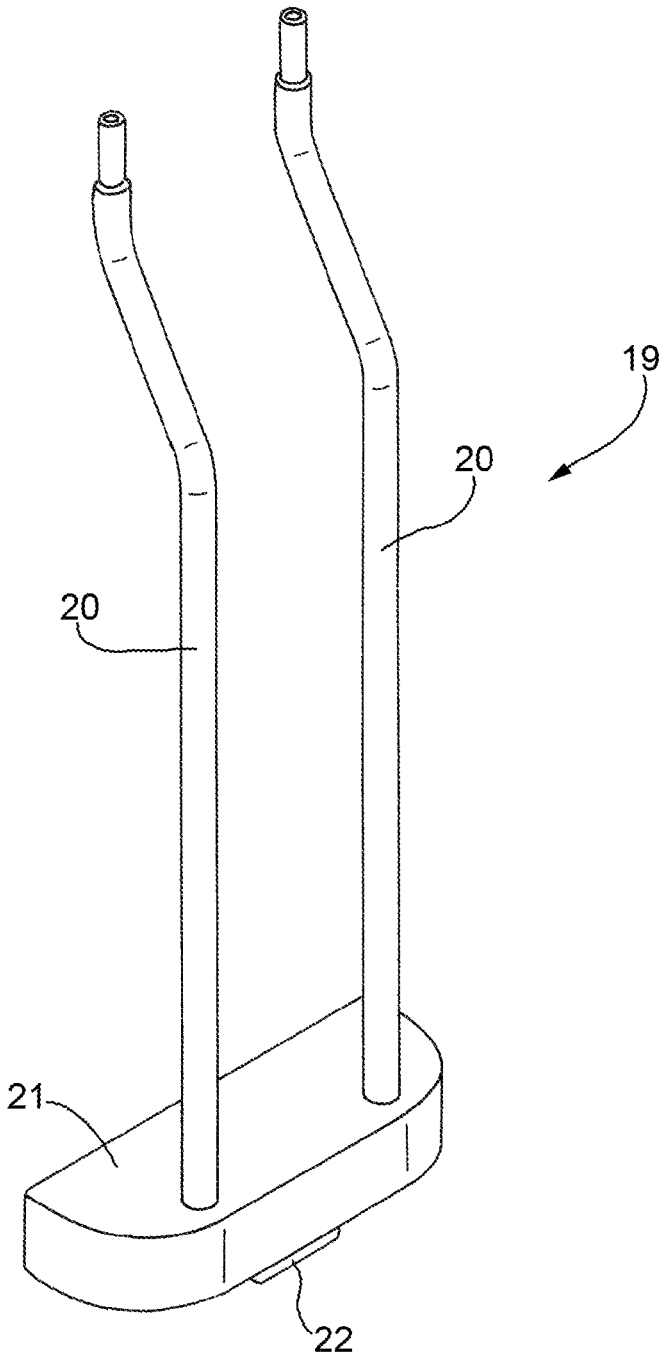
FIG. 3 is a diagrammatic perspective view of a variant of a detail of the gripping element in FIGS. 1 and 2.
Figure 4:
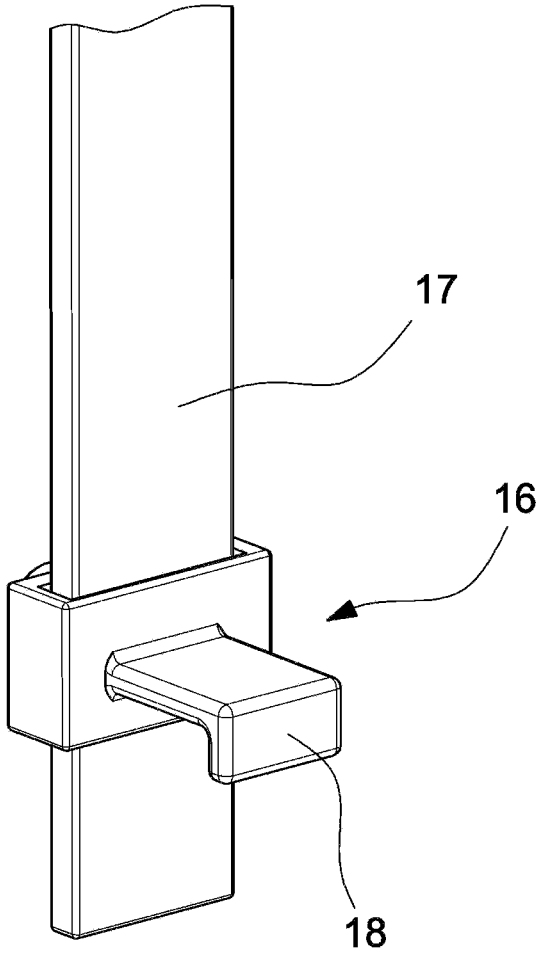
FIG. 4 is a perspective view showing a second gripping element in the form of a hook relatively moveable with respect to the bracket.
Figure 5:
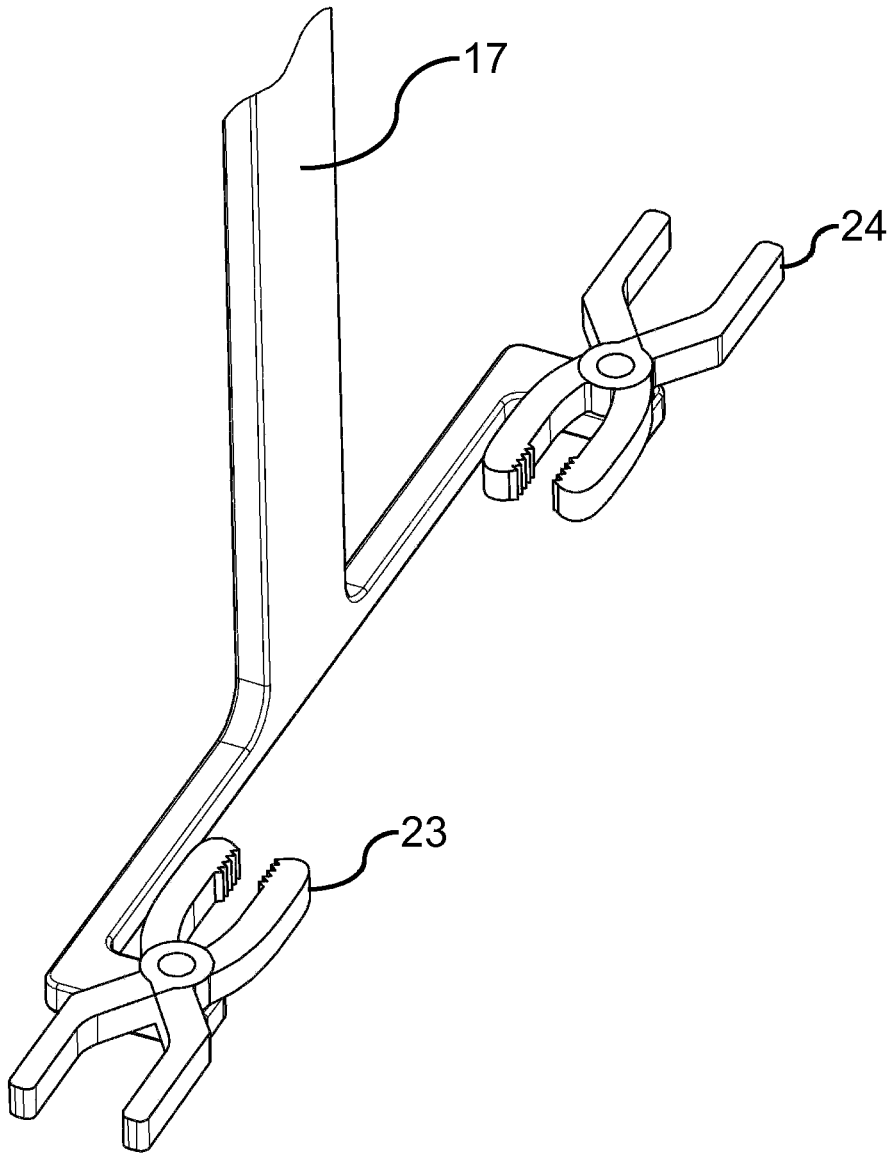
FIG. 5 is a perspective view showing a second gripping device according to a second embodiment of the invention, the second gripping device including first and second plier gripping elements moveable with respect to each other.

In the variant shown in FIG. 3, the gripping device 16 is eliminated and replaced by a gripping device 19 comprising two respectively parallel guiding rods 20, which protrude from one of the jaws 8, 9, and are slidably engaged by a substantially flat resting plate 21, which extends transversally to the rods 20, is locked along the rods 20, e.g. by means of at least one locking screw (of the known type and not shown), is arranged so as to allow the edge 5 to wind about the plate 21, and is provided with a hook 22, which protrudes from the plate 21 from opposite side of the bag 2, and is adapted to engage the opening 6 of the edge 5 itself.

Finally, it is worth noting that the gripping element 1 may be either disposable or reusable and may be sterilized either individually or along with the bag 2 and the content thereof.

We claim:

1. A process of holding and orienting a bag for pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

wherein the bag comprises at least one opening at the second edge and wherein gripping the second edge comprises engaging the opening with a hook of the second gripping device.

2. The process of claim 1 comprising orienting the bag according to the horizontal position and to the second vertical position.

3. The process of claim 2 wherein the bag comprising an inlet duct at the first edge and wherein the inlet duct is oriented upwards in the first vertical position and is oriented downwards in the second vertical position.

4. The process of claim 3, wherein gripping the first edge comprises moving a pair of gripping jaws of the first gripping device from release position to a clamping position of the inlet duct.

5. The process of claim 1, wherein gripping the first edge comprises moving a pair of gripping jaws of the first gripping device from release position to a clamping position of the first edge.

6. The process of claim 5, wherein the gripping jaws of the first gripping device are mutually hinged to rotate one with respect to the other around a given fulcrum axis, and wherein gripping the first edge comprises locking the gripping jaws in the clamping position thereof.

7. The process of claim 5, wherein the gripping jaws of the first gripping device comprise two separate, distinct parts, one of which is provided with at least one tooth and the other is provided with at least one slot and wherein gripping the first edge comprises receiving and withholding the at least one tooth in the at least one slot.

8. The process of claim 1, further comprising adjusting the distance between the first and the second gripping devices according to the size of the bag.

9. The process of claim 1, further comprising tensioning the bag by controlling the distance between the first and the second gripping devices.

10. A process of holding and orienting a bag in a machine for preparing pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

wherein the bag comprises at least one opening at the second edge and wherein gripping the second edge comprises engaging the opening with a hook of the second gripping device.

11. The process of claim 10, comprising orienting the bag according to the horizontal position and to the second vertical position.

12. The process of claim 11, wherein the bag comprising an inlet duct at the first edge and wherein the inlet duct is oriented upwards in the first vertical position and is oriented downwards in the second vertical position.

13. The process of claim 10, further comprising adjusting the distance between the first and the second gripping devices according to the size of the bag.

14. The process of claim 10, further comprising tensioning the bag by controlling the distance between the first and the second gripping devices.

15. A process of holding and orienting a bag for pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position, and a second vertical position, wherein the first edge is arranged underneath the second edge;

wherein gripping the second edge comprises moving at least one plier of the second gripping device from a release position to a clamping position of the second edge.

16. The process of claim 15, further comprising orienting the bag according to the horizontal position and to the second vertical position.

17. The process of claim 16, wherein the bag comprising an inlet duct at the first edge and wherein the inlet duct is oriented upwards in the first vertical position and is oriented downwards in the second vertical position.

18. The process of claim 15, further comprising adjusting the distance between the first and the second gripping devices according to a size of the bag.

19. The process of claim 15, further comprising tensioning the bag by controlling the distance between the first and the second gripping devices.

20. A process of holding and orienting a bag for pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position, and a second vertical position, wherein the first edge is arranged underneath the second edge;

wherein gripping the second edge comprises winding the bag about a supporting plate.

21. The process of claim 20, further comprising orienting the bag according to the horizontal position and to the second vertical position.

22. The process of claim 21, wherein the bag comprising an inlet duct at the first edge and wherein the inlet duct is oriented upwards in said first vertical position and is oriented downwards in the second vertical position.

23. The process of claim 20, further comprising adjusting the distance between the first and the second gripping devices according to a size of the bag.

24. The process of claim 20, further comprising tensioning the bag by controlling the distance between the first and the second gripping devices.

25. A process of holding and orienting a bag for pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

adjusting the distance between the first and the second gripping devices according to the size of the bag.

26. The process of claim 25, further comprising orienting the bag according to the horizontal position and to the second vertical position.

27. The process of claim 26, wherein the bag comprising an inlet duct at the first edge and wherein the inlet duct is oriented upwards in the first vertical position and is oriented downwards in the second vertical position.

28. A process of holding and orienting a bag for pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

tensioning the bag by controlling the distance between the first and the second gripping devices.

29. The process of claim 28, further comprising orienting the bag according to the horizontal position and to the second vertical position.

30. The process of claim 29, wherein the bag comprising an inlet duct at the first edge and wherein the inlet duct is oriented upwards in the first vertical position and is oriented downwards in the second vertical position.

31. A process of holding and orienting a bag for pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

wherein gripping the first edge comprises moving a pair of gripping jaws of the first gripping device from release position to a clamping position of the first edge, wherein the gripping jaws of the first gripping device are mutually hinged to rotate one with respect to the other around a given fulcrum axis, and wherein gripping the first edge comprises locking the gripping jaws in the clamping position thereof.

32. The process of claim 31, further comprising orienting the bag according to the horizontal position and to the second vertical position.

33. The process of claim 32, wherein the bag comprising an inlet duct at the first edge and wherein the inlet duct is oriented upwards in the first vertical position and is oriented downwards in the second vertical position.

34. The process of claim 31, further comprising adjusting the distance between the first and the second gripping devices according to the size of the bag.

35. The process of claim 31, further comprising tensioning the bag by controlling the distance between the first and the second gripping devices.

36. A process of holding and orienting a bag in a machine for preparing pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

wherein gripping the second edge comprises moving at least one pliers of the second gripping device from a release position to a clamping position of the second edge.

37. The process of claim 36, further comprising orienting the bag according to the horizontal position and to the second vertical position.

38. The process of claim 37, wherein the bag comprising an inlet duct at the first edge and wherein the inlet duct is oriented upwards in the first vertical position and is oriented downwards in the second vertical position.

39. The process of claim 36, further comprising adjusting the distance between the first and the second gripping devices according to the size of the bag.

40. The process of claim 36, further comprising tensioning the bag by controlling the distance between the first and the second gripping devices.

41. A process of holding and orienting a bag in a machine for preparing pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

wherein gripping the second edge comprises winding the bag about a supporting plate.

42. The process of claim 41, further comprising orienting the bag according to the horizontal position and to the second vertical position.

43. The process of claim 42, wherein the bag comprising an inlet duct at the first edge and wherein the inlet duct is oriented upwards in the first vertical position and is oriented downwards in the second vertical position.

44. The process of claim 41, further comprising adjusting the distance between the first and the second gripping devices according to the size of the bag.

45. The process of claim 41, further comprising tensioning the bag by controlling the distance between the first and the second gripping devices.

46. A process of holding and orienting a bag in a machine for preparing pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

adjusting the distance between the first and the second gripping devices according to the size of the bag.

47. The process of claim 46, further comprising orienting the bag according to the horizontal position and to the second vertical position.

48. The process of claim 47, wherein the bag comprising an inlet duct at the first edge and wherein the inlet duct is oriented upwards in the first vertical position and is oriented downwards in the second vertical position.

49. A process of holding and orienting a bag in a machine for preparing pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

tensioning the bag by controlling the distance between the first and the second gripping devices.

50. The process of claim 49, further comprising orienting the bag according to the horizontal position and to the second vertical position.

51. The process of claim 50, wherein the bag comprising an inlet duct at the first edge and wherein the inlet duct is oriented upwards in the first vertical position and is oriented downwards in the second vertical position.

52. A process of holding and orienting a bag in a machine for preparing pharmaceutical products, the bag comprising a first edge and a second edge opposed to the first edge, the process comprising:

gripping the first edge with a first gripping device, gripping the second edge with a second gripping device, orienting the bag according to a first vertical position, wherein the first edge is arranged above the second edge, and orienting the bag according to one of:

a horizontal position and a second vertical position, wherein the first edge is arranged underneath the second edge;

wherein gripping the first edge comprises moving a pair of gripping jaws of the first gripping device from release position to a clamping position of the first edge, wherein the gripping jaws of the first gripping device are mutually hinged to rotate one with respect to the other around a given fulcrum axis, and wherein gripping the first edge comprises locking the gripping jaws in the clamping position thereof.

53. The process of claim 52, further comprising orienting the bag according to the horizontal position and to the second vertical position.

54. The process of claim 53, wherein the bag comprising an inlet duct at the first edge and wherein the inlet duct is oriented upwards in the first vertical position and is oriented downwards in the second vertical position.

55. The process of claim 52, further comprising adjusting the distance between the first and the second gripping devices according to the size of the bag.

56. The process of claim 52, further comprising tensioning the bag by controlling the distance between the first and the second gripping devices.

* * * * *